United States Patent [19]

Ikeda

[11] 4,429,367

[45] Jan. 31, 1984

[54] SPEECH SYNTHESIZER APPARATUS

[75] Inventor: Hidenori Ikeda, Tokyo, Japan

[73] Assignee: Nippon Electric Co., Ltd., Tokyo, Japan

[21] Appl. No.: 298,409

[22] Filed: Sep. 1, 1981

[30] Foreign Application Priority Data

Sep. 1, 1980 [JP] Japan ..... 55-120841

[51] Int. Cl.[3] ..... G10L 1/00

[52] U.S. Cl. ..... 364/513; 381/51

[58] Field of Search ..... 179/1 SM, 1 SG; 364/513; 381/51

[56] References Cited

U.S. PATENT DOCUMENTS 3,641,496 2/1972 Slavin ..... 179/1 SM 4,117,263 9/1978 Yeh ..... 179/1 SM 4,282,404 8/1981 Tanimoto et al. ..... 179/1 SM

*Primary Examiner*—Emanuel S. Kemeny

*Attorney, Agent, or Firm*—Sughrue, Mion, Zinn, Macpeak and Seas

[57] ABSTRACT

A speech synthesis device includes a memory for storing speech information at a plurality of memory locations with each location commencing at a respective leading address, and a table of leading addresses is maintained in the memory. At the beginning of operation, the leading addresses are read from the table and stored in a random access memory so that the leading addresses can be selectively accessed by keyed in information. Address generation circuitry will then successively address the data in each information area of memory in reponse to a particular accessed leading address.

5 Claims, 8 Drawing Figures

SPEECH SYNTHESIZER APPARATUS

BACKGROUND OF THE INVENTION

The present invention relates to a speech synthesizer apparatus, and more particularly to a speech synthesizer apparatus having a memory storing information necessitated for speech synthesis in which information is selected and taken out of the memory and speech is synthesized on the basis of the taken-out information.

The field of application of a speech synthesizer apparatus is spreading more and more in recent years. Moreover, a number of kinds of speech synthesizing techniques have been heretofore published, and recently a speech synthesizer apparatus making use of a microcomputer has attracted the public eye and has begun to be used widely. Briefly speaking, a microcomputer is composed of a first memory for storing a plurality of groups of instructions (i.e. microinstructions) to be used for processing speech synthesis, a second memory for storing processed data and a central processing unit (CPU) for processing data on the basis of the instructions. This has been rapidly developed owing to the progress of the LSI technique, and it involves many advantages such as compactness, light weight, low cost, etc. Accordingly, synthesizing processing can be achieved simply and at a low cost with the microcomputer applied to the speech synthesizer. In such a case, normally the instructions for controlling speech synthesis are stored in the above-referred first memory, and synthesizing processing is effected by the above-referred CPU (also called "microprocessor"). Further, data processed for synthesis are stored in the above-referred second memory. It is to be noted that speech information could be stored either in the first memory or in the second memory. However, in the case where the necessary speech information is obtained by analyzing pronounced original speech and subsequently speech synthesis is effected on the basis of the obtained speech information, it is preferable to store the speech information in the second memory which is formed as a memory capable of writing and reading information (i.e. RAM: random access memory). On the other hand, in the case where speech synthesis is effected on the basis of preliminarily prepared speech information, it is preferable to have the speech information preliminarily stored in the first memory which is formed as a read-only memory (ROM) in which information is permanently stored. A speech signal obtained after completion of the synthesizing processing is normally subjected to digital-analog conversion and fed to a loud speaker via a filter and an amplifier to be pronounced from the loud speaker.

The above description has been made merely for explaining the simplest construction to practice a speech synthesizing technique and a data processing technique in combination, and as a matter of course, it is possible to combine, besides the microcomputer, a personal computer, minicomputer or large-scale computer having higher program processing capabilities with the speech synthesizing technique. It is to be noted that the present invention is not limited to the use of a microcomputer but is equally applicable to the case where a large-scale computer, a personal computer, or a minicomputer is employed.

The heretofore known or already practically used speech synthesizing techniques are generally classified into two types. One is a parameter synthesizing technique, in which parameters characterizing a speech signal are preliminarily extracted. Speech is synthesized by controlling multiplier circuits and filter circuits according to these parameters. As representative apparatuses of this type, there are known a linear predictive coding synthesizer apparatus and a formant synthesizer apparatus. The other type is a waveform synthesizing technique, in which waveform information such as an amplitude and a pitch sampled from a speech signal waveform at predetermined time intervals are preliminarily digitized. A speech signal is synthesized by sequentially combining each digital waveform information. As representative apparatuses of this type, there are known PCM (Pulse Coded Modulation), DPCM (Differential PCM) and ADPCM (Adaptive DPCM) synthesizer apparatuses, and a phoneme synthesizer apparatus which joins waveforms of primary phonemes forming the minimum units of speech successively to each other.

The present invention is characterized in processing mechanism for reading such parameter information or waveform information out of a memory and supplying it to a synthesizing processor. Therefore, more detailed description of the various types of synthesizing techniques as referred to above will be omitted here. However, it is one important merit of the present invention that the invention is equally applicable all of these synthesizing techniques. This is because in every speech synthesizing technique a digital processing technique such as a computer technique is involved and storing speech information (parameter information or waveform information) in a memory and reading information from a memory are essentially necessary processings.

In a heretofore known speech synthesizer apparatus, parameter information or waveform information of speech (hereinafter called simply "speech information") is written in a memory and the speech information is read out in accordance with address data fed from a CPU. For this purpose, the CPU′includes an address data generating circuit which generates an address where a synthesized speech information is stored, in response to speech designating data from a speech request section such as a key board. That is, the same system as the address system of the conventional digital computer is employed. In other words, a program is preliminarily prepared so as to be able to synthesize desired speech, and addresses are generated according to the prepared program. In some commercially available speech synthesizers, designation of speech to be synthesized is effected by key operations. The procedure of processing is started by designating speech (anyone of phone, word and sentence) by means of a key input device. A key data is converted into a predetermined key code (key address), which is in turn converted into address data and applied to a memory. The applied address data serve as initial data, and a plurality of consecutive addresses are produced and successively applied to the memory. As a result, speech information stored at the designated memory locations is successively transferred to a CPU, and then synthesizing processing is commenced. However, the key input data and the address data of the memory had to be correlated in one-to-one correspondence. As viewed from the memory side, speech information had to be preliminarily stored at predetermined locations in the memory as correlated to the key data of the key input device.

Therefore, in the heretofore known speech synthesizer apparatus it was not allowed to disturb the relation between the key input device (or speech synthesizing program) and a memory for storing speech information, especially the basic rule of making the key data and the memory address coincident to each other. On the other hand, the quantity of speech information (the number of addresses to be preset in a memory) will be different in various manners depending upon a difference in a speech synthesizing system and a difference in speech itself. Accordingly, the respective leading addresses of the memory locations where respective first speech information of the respective information group of speech is to be stored cannot be preset at equal intervals or with the same address capacity. If it is assumed that the leading addresses of each speech were preset at equal intervals, the interval between the respective leading addresses must be selected so as to meet the speech having the largest quantity of information. Therefore, capacity of the memory becomes so large that it is not economical. Even from such a view point also, it will be understood that in the heretofore known speech synthesizer apparatus, the key data of a key input device must have one-to-one correspondence to the memory address of the speech information storage memory.

In the heretofore known speech synthesizer apparatus, as the key data is coincident with the memory address in the above-described manner, change of a memory was not allowed. More particularly, in the case where a presently used memory is to be changed to a memory of another speech, the leading address of the speech information stored in the replaced memory is different from that of the original memory. This is caused by the fact that the quantity of information is different depending upon the speech to be synthesized, as described previously. Accordingly, together with the replacement of a memory, the key data of the key board or the addressing system of the CPU also must be changed in the corresponding manner. Especially, in order to change the key data, the key input device itself must be replaced. Further, change of the address system of the CPU requires change of the hardware for generating a memory address depending on the key address and software for controlling the processing of the memory address. Therefore, it requires a lot of time and human labor as is well known. In addition, checking of a memory address generating program is also necessitated. As described above, if it is intended to replace a memory, then change of another portion of the apparatus becomes necessary, and hence, not only the apparatus becomes complex but also the operation becomes troublesome.

Furthermore, where a memory is to be newly added to the prior art synthesizers, the codes of the key data and addresses output from the CPU has to be newly preset at the time of adding the memory so as to correspond to the respective leading addresses in the additional memory. Therefore, modification of a hardware circuit (especially an interface between a CPU and a key input device) is necessitated, and hence there is a shortcoming that the speech synthesizer apparatus lacks adaptability to different applications.

SUMMARY OF THE INVENTION

It is therefore one object of the present invention to provide a speech synthesizer apparatus in which change and/or addition of a speech information memory can be achieved easily.

Another object of the present invention is to provide a speech synthesizer apparatus which can synthesize a lot of speech while switching memories within a short period of time.

Still another object of the present invention is to provide a processing apparatus that is composed of a key input device, microprocessor and a memory and adapted to be formed in an integrated circuit.

A still further object of the present invention is to provide a speech processing apparatus which comprises novel means for reading out memory information to enhance an expansibility of a memory capacity.

The speech synthesizer apparatus according to the present invention comprises a memory storing a plurality of speech information, means for reading respective speech information out of the memory, means for synthesizing speech, means for feeding the respective speech information read out of the memory to the speech synthesizing means and means for pronouncing the synthesized speech, wherein the reading means includes a first circuit for editing leading addresses of the respective speech information stored in the memory, a second circuit for accessing to one of the leading addresses edited by the first circuit and a third circuit for sequentially transferring consecutive addresses to the memory which start from the accessed leading address. The respective speech information consequently read are respectively fed to the speech synthesizing means to be subjected to synthesizing processing.

In the speech synthesizer apparatus according to the present invention, it is avoided to directly read speech information out of a memory as is the case of the prior art apparatus, and instead provision is made such that at first, leading addresses of the respective pieces of speech information are read out and edited and subsequently speech information is read out by making use of the edited addresses. Accordingly, in whatever sequence or at whatever interval the leading addresses (start addresses for accessing the respective first information in the speech information group, such as a phoneme, a phone, a word, a sentence, or the like) of the respective pieces of information may be distributed, owing to the editing processing the respective leading addresses can be rearranged at predetermined edited positions. Since these edited positions can be defined as predetermined or fixed positions, the input information for deriving speech information from a memory (the key data or the memory address of the CPU in the prior art apparatus) could be made to correspond to the information representing these edited positions. As a result, whatever memory may be used, speech information can be derived from an appropriate location in the memory without modifying the input section, especially an address system. Accordingly, change and/or addition of a memory can be achieved easily and complex modification of a circuit is not necessitated at all. Moreover, the correspondence between the key input (or program input) data which designates a speech which should be synthesized in the memory and the edited positions, is independent of the change of the memory. That is, it is only necessary to maintain a predetermined relation therebetween. Accordingly, the relation between an input section and an editing section, especially the designation of addresses from the input section to the editing section could be fixed regardless of the change of the memory, and so, modification of a circuit is unnecessary. In addition, since circuit modification in the input section (speech designating section) and the speech information read section is unnecessary, various kinds of speech can be synthesized by merely mounting different memories. In other words, there is no limit to the synthesizable speech, and so, the speech synthesizer according to the present invention has an extremely wide utility.

BRIEF DESCRIPTION OF THE DRAWINGS

In the following, more detailed description will be made on a preferred embodiment of the present invention with reference to the accompanying drawings, wherein.

DESCRIPTION OF THE PRIOR ART

Figure 1:
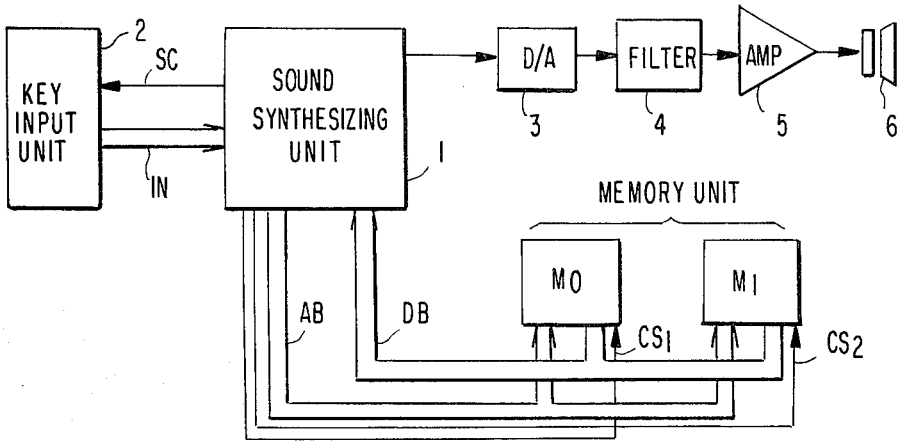
FIG. 1 (PRIOR ART)
FIG. 1 is a block diagram of a speech synthesizer apparatus in the prior art.

As shown in FIG. 1, a speech synthesizer apparatus in the prior art comprises a sound synthesizing unit 1, memories M0 and M1 for storing speech information, and an input unit 2 for designating speech to be synthesized. A synthesized output produced by the sound synthesizing unit 1 is converted into an analog signal by a digital-analog converter 3 and is led to a loud speaker 6 via a filter 4 and an amplifier 5 to pronounce the speech. The signal paths between the respective units take a bus construction. A scan signal SC for searching input information is transmitted at predetermined intervals from the sound synthesizing unit 1 to the input unit 2. The searched input information (a key data) is transferred into the sound synthesizing unit 1 through a bus IN. The input information is subjected to the procedures as fully described in the following and then fed to the memories $M_1$ and $M_2$ as addresses via address bus AB. Speech information is sequentially read out of the memory locations designated by the addresses and taken into the sound synthesizing unit 1 through a data bus DB. On the basis of the speech information taken into the sound synthesizing unit 1, processing according to a predetermined synthesizing system is commenced. The processed speech information is output as a speech signal OUT.

In such a speech synthesizer apparatus, the synthesizing processing is simple because the hardware means is fixedly determined depending upon the speech to be synthesized, but the apparatus has an extremely poor generality in use.

Figure 2:
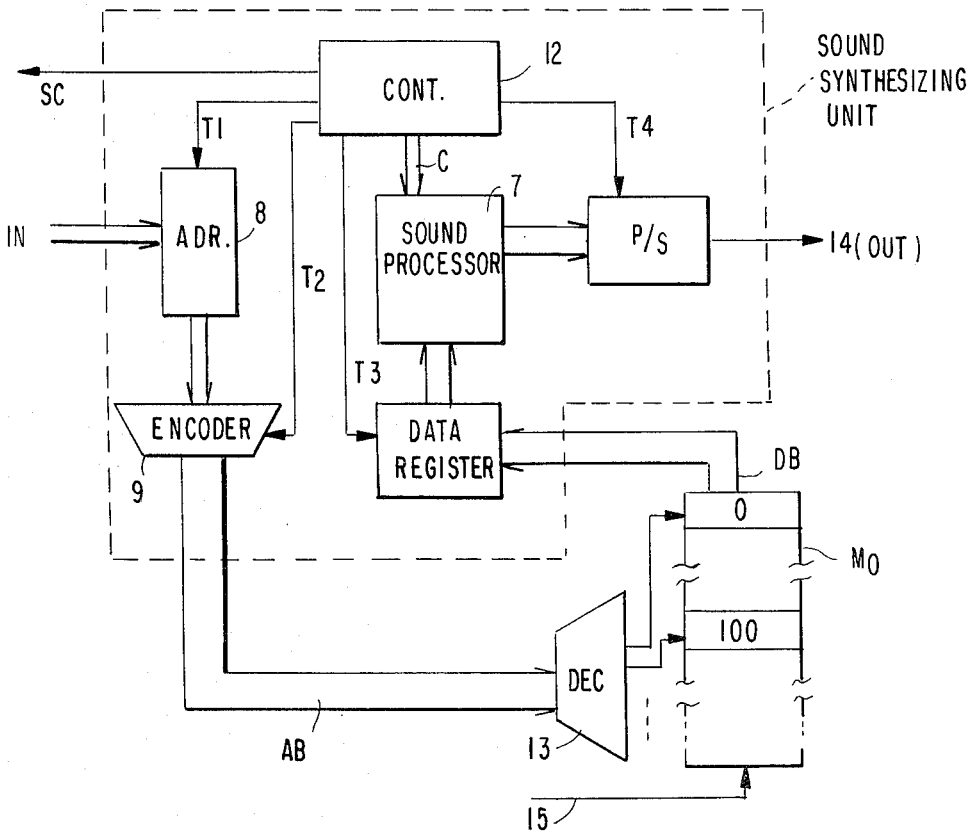
FIG. 2 (PRIOR ART)
FIG. 2 is a block diagram showing a sound synthesizing unit and a memory in the prior art.

In the following, description will be made of such shortcomings. Here, reference should be made to FIG. 2. This figure is a block diagram showing the relations between circuit blocks in a sound synthesizing unit and a memory. Key input information fed to the sound synthesizing unit is temporarily stored in an address register 8. The input information is transferred to an encoder 9 in synchronism with a timing signal $T_1$ fed from a controller 12, and is coded in the encoder 9. This encoder 9 generates a memory address positioned at the starting point of speech information designated by the Key input information. That is, the address produced by the encoder 9 corresponds to the address of the memory. The address data is transferred through an address bus AB to a decoder 13. As a result of decoding, the address data are fed to a memory $M_0$ as a selection signal. In the memory $M_0$ there is already stored speech information. In this memory $M_0$, a first speech information group (it could be a phone, word or sentence) is stored, for instance, at the area between leading address 0 which serves as a start address and address 99. In addition, a second speech information group is stored, for instance, at the subsequent consecutive addresses, that is, at address 100 which serves as a start address (leading address) and the subsequent addresses. In this way, the respective pieces of speech information are stored in a consecutive manner without keeping any vacant address. This is very advantageous in view of effective use of a memory. The key input information is coded so as to be adapted to such address assignment of the memory. More particularly, the speech designation signals fed from the input unit 2 are coded by the encoder 9 so that they can designate the respective leading addresses of each speech information group in the memory M0. Thus, the prior art synthesizer apparatus generates coded signals depending upon leading addresses in a memory. On the other hand, there is known a synthesizer apparatus in which coded signals are generated by means of software. However, this apparatus had a shortcoming that it is expensive and yet slow in processing speed. In addition, software generating a coded address corresponding to a memory address needs program modification when a memory is changed or newly added. In any event, input information adapted for the memory construction is necessitated, and coded information adapted for a memory address must be produced. Therefore, the apparatus has a disadvantage that it cannot adapt to change or addition of a new memory. Especially, since the speech information blocks in the memory have various sizes depending upon the speech, the distribution of the respective leading addresses has no regularity at all. Furthermore, it is extremely difficult to set input information and coded information so as to be adaptable to every speech.

As described above, in the heretofore known speech synthesizer apparatus, since the address data for a memory had one-to-one correspondence to the leading addresses of the memory to be used, a poor generality in use resulted. Further, speech information read out of a memory is temporarily stored in a data register 10 and is transferred to a sound processor (synthesizer) 7 as synchronized with a timing signal $T_3$. In this sound processor 7, a desired synthesizing processing is effected in response to a control signal C that is generated to execute a synthesizing instruction, and the processed data are fed to a parallel-serial converter 11. This P/S converter 11 is provided in the output stage, and the data are output serially one bit by one bit as synchronized with an output timing signal $T_4$.

DETAILED DESCRIPTION OF THE PREFERRED EMBODIMENT

Figure 3:
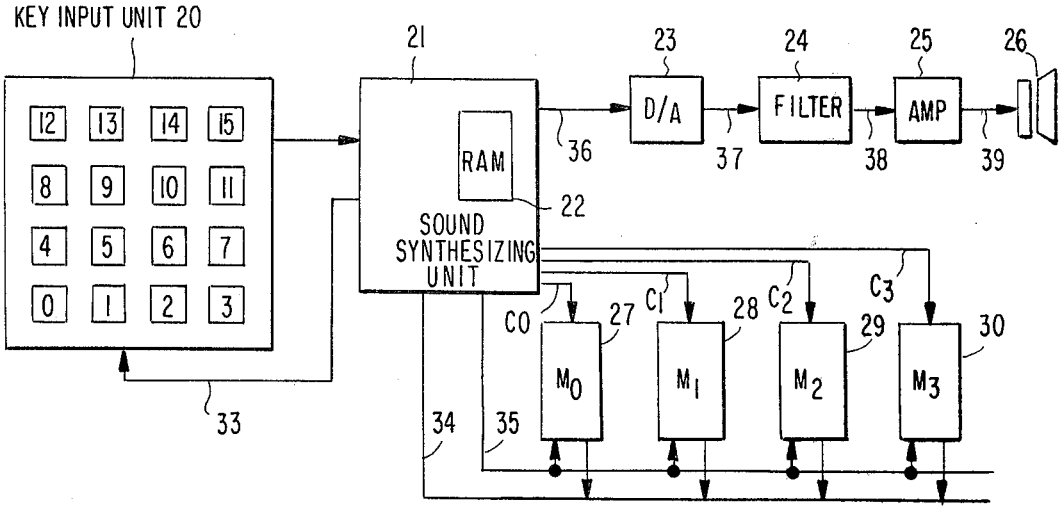
FIG. 3 is a block diagram of a speech synthesizer apparatus according to one preferred embodiment of the present invention.

FIG. 3 is a block diagram showing one preferred embodiment of the present invention. It is to be noted that description will be made here, by way of example, in connection to the case where a key input unit is employed as speech designating means and a parameter synthesizing system is employed as speech synthesizing means.

A speech synthesizer apparatus according to the illustrated embodiment comprises a key input unit 20 having 16 keys, a sound synthesizing unit 21 for executing a synthesizing processing, and memories for storing speech information (four memories ($M_0$–$M_3$) are prepared in the embodiment). For connecting the sound synthesizing unit 21 to the key input unit 20, a key scan signal line 33 and a key input signal line 32 are necessitated. On the other hand, the sound synthesizing unit 21 is coupled to the respective memories $M_0$ to $M_3$ by means of a data bus 34, address bus 35 and four memory selection signal lines $C_0$ to $C_3$. A synthesized speech digital signal 36 is converted into an analog signal 37 through a digital-analog converter 23. Thereafter, a noise is eliminated via a filter 24, and a speech signal 39 amplified by an amplifier 25 is pronounced by a loud speaker 26.

In such a speech synthesizer construction, especially the key inut from the key input unit 20 and the address designation for the memories are executed by the novel circuit construction which involves a unique contrivance according to the present invention. Now, in order to clarify the flows of key input data for designating speech, address data for memories and speech information read out of the memories, description will be made with reference to FIG. 4, which illustrates only elements disposed within the sound synthesizing unit 21, memories $M_0$ and $M_1$ (only two of the four memories $M_0$–$M_3$) and signal lines interconnecting these elements in FIG. 3.

Within the sound synthesizing unit 21 are provided a read-only memory (ROM) 40, a random access memory (RAM) 22, a sound processor 42, a controller 43, an address generator circuit 51, and a parallel-serial converter circuit 52. In addition, there is provided an address register 44 as a circuit for designating an address in the RAM 22 in response to the key input IN. Moreover, into the RAM 22 are written the results of the processing as will be described later, in the form of data. The processing uses an arithmetic and logical unit (ALU) 50, and data set registers 48 and 49 coupling to the ALU 50, respectively. In the ROM 40 is preliminarily stored a table of a control program (micro-program instruction group) and speech parameters (as will be described later). The instructions are decoded by an instruction decoder (ID) 46 and fed to the controller 43 as decoded signals 53. To the memories $M_0$ and $M_1$ are transmitted addresses from the address generator circuit 51. The address comprises a memory select address $C_o$–$C_n$ to be applied independently to each memory and a cell select address AD to be applied in common to all the memories. The data read out of the memory are transmitted via a common bus DB to the register 49 and the sound processor 42.

In addition, to the sound processor 42 are also input the speech parameters read out of the ROM 40 through a selecting circuit 47 for selecting the speech parameters. In the case of the parameter synthesizing system, the sound processor 42 comprises filters and multiplier circuits, and synthesizing processing is effected by these circuits on the basis of the input speech information. For controlling the processing, control signals CONT. transmitted from the controller 43 are used. The synthesized speech signal is fed to the parallel-serial converter circuit 52, and then it is output serially therefrom one bit by one bit. It is to be noted that if there exists vacancy in the output terminals of the speech synthesizer apparatus, then the parallel bits could be in themselves transmitted through the vacant (not-used) terminals to a digital-analog converter (23 in FIG. 3). In this case, the parallel-serial converter circuit 52 can be omitted. This sound synthesizing unit 21 is further provided with a memory detector circuit 45, so that it can detect whether a memory is connected to the bus or not. Furthermore, there is a stop detector circuit 54 for detecting termination of speech synthesis.

Figure 5:
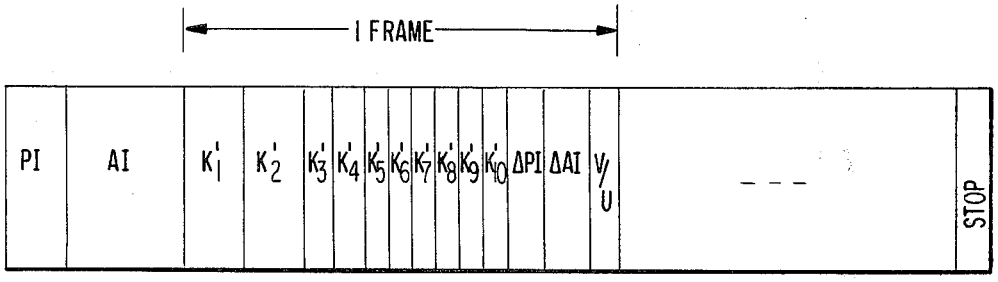
FIG. 5 is a data map showing one frame of speech information to be stored within a memory.

Now description will be made of speech information that is available in the parameter synthesizing system employed in the illustrated embodiment. A speech signal is sampled for each interval of 10 ms–20 ms (called one frame), and a plurality of characterizing parameters (K-parameters), data representing increments or decrements of pitch and amplitude ΔPI respectively, and ΔAI, and data representing either voiced sound or unvoiced sound V/U for characterizing the sampled speech signal, are produced from the sampled data in a well known manner. FIG. 5 illustrates such speech information data obtained by sampling and analyzing a speech signal. The produced data are sequentially stored in a memory and grouped for each unit of speech to be synthesized. As the unit of speech, any unit such as a phoneme, a phone, word or sentence unit could be employed. As information representing a boundary between adjacent speech units, a stop datum (STOP) indicating termination of speech data is provided at the end of the speech information. This is detected by the stop detector circuit 54. With reference to FIG. 5, data PI and AI represent a speech unit. It is to be noted that in the illustrated embodiment, with regard to the K-parameter data to be stored in a memory, the corresponding addresses ($K'_1$–$K'_{10}$) of a memory in which the K-parameters are stored (the ROM 40 in the sound synthesizing unit 21) are set into the memories $M_0$, $M_1$ . . . , instead of the K-parameters themselves. This is due to the fact that the frequency of use of the K-parameters is high and also the quantity of data of the K-parameter is large, and hence if the K-parameters were to be set in themselves in the memories $M_0$, $M_1$, - - - , memories having an extremely large capacity would be necessitated. Therefore, if the K-parameters are prepared in a form of a table within the ROM 40 and the addresses of the ROM 40 are stored in the memories as is the case with the illustrated embodiment, it is possible to largely compress the quantity of information.

Figure 6:
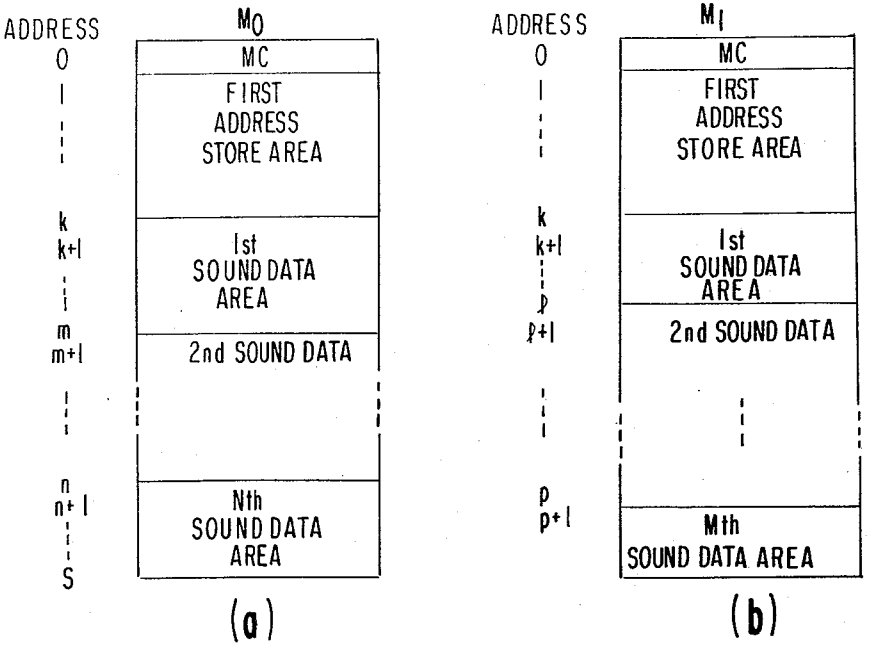
FIG. 6 shows memory maps of two memories (M0, M1)

Now the constructions of the memories $M_0$ and $M_1$ will be explained with reference to FIGS. 6 and 7. FIGS. 6(*a*) and 6(*b*) illustrate the entire construction (address map) of the memories $M_0$ and $M_1$, respectively. In these respective memories, the areas from address 0 to address k have the same address map. More particularly, at address 0 is set a memory confirmation code (MC), and in the area from address 1 to address k are assembled start addresses (a name code of speech information) of the respective groups of speech information.

Figure 7:
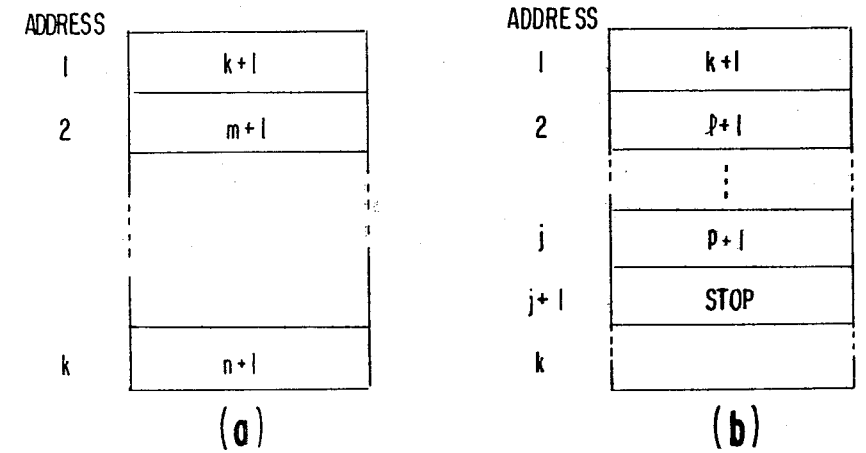
FIG. 7 shows data maps of the respective leading address storing areas of the two memories (M0, M1)

The states of these areas in the respective memories are shown in FIGS. 7(*a*) and 7(*b*). Here it is assumed that in the memory $M_0$ are written N speech information groups and in the memory $M_1$ are written M speech information groups. Furthermore, it is assumed that the first addresses of the respective speech information groups in the memory $M_0$ are k+1, m+1, . . . , n+1, and those in the memory $M_1$ are k+1, l+1, . . . , p+1. Although not required, the leading address K+1 of the first sound data area may generally be common to both memories $M_0$ and $M_1$, and the other leading addresses are generally different from each other. This is a difference necessarily caused by the variety of the speech information groups.

In the leading address store area (addresses 1-k) of the memory $M_0$ are stored the leading address data of k+1, m+1, . . . , n+1, at addresses 1, . . . , k as shown in FIG. 7(*a*). On the other hand, in the memory $M_1$, leading address data of k+1, l+1, . . . , P+1, STOP are stored similarly at addresses 1, . . . , j+1, as shown in FIG. 7(*b*). Since the quantity of information stored in the memory $M_1$ is less than that stored in the memory $M_0$, in the leading address store space only addresses 1 to j are used for storing the leading addresses in the memory $M_1$, and at the next subsequent address, that is, at address j+1 is set the code representing the termination of the series of leading addresses, i.e. the termination of the synthesized speech in the memory $M_1$. Therefore, addresses j+2 to k are kept vacant.

Figure 4:
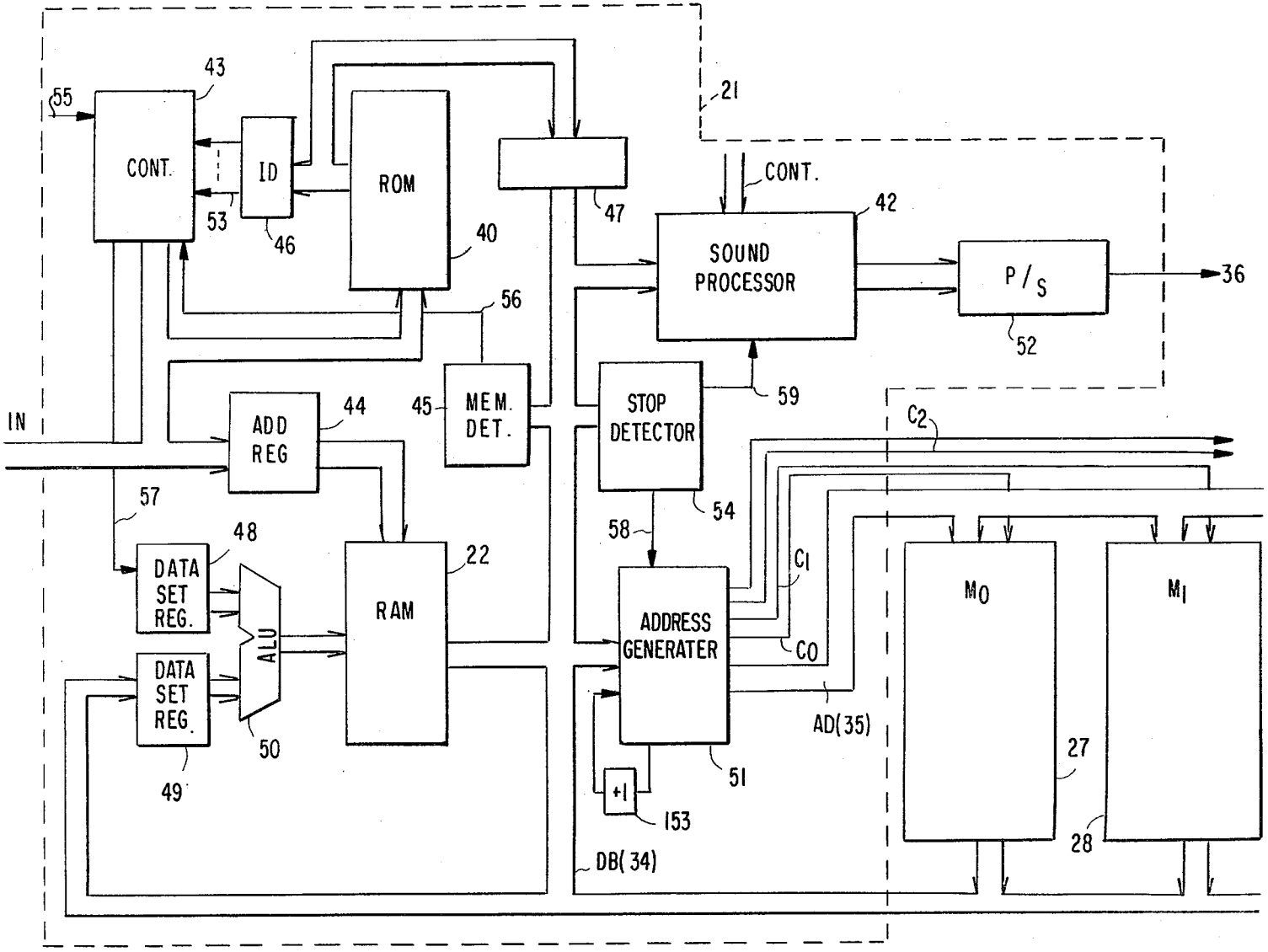
FIG. 4 is a block diagram showing a sound synthesizing unit in the preferred embodiment shown in FIG. 3, especially showing means for accessing to speech information within a memory on the basis of speech designating information (input information)

Now the operations of the sound synthesizing unit and memories will be explained in the following with respect to the case where the memories $M_0$ and $M_1$ are connected via buses to the sound synthesizing unit 21. In FIG. 4, it is assumed that the memories $M_0$ and $M_1$, respectively, have the address maps as shown in FIGS. 6(*a*) and 6(*b*). The sound synthesizing unit 21 is adapted to set its inner circuits at their initial conditions by an initial signal 55, either upon switching on the power supply or in response to execution of a speech synthesis start instruction or a signal for designating synthesis start fed from the key input unit. Furthermore, processing is effected such that the leading address data set in the respective leading address stored areas of the memories $M_0$ and $M_1$ are read out and sequentially edited at predetermined positions (predetermined memory locations) in the RAM 22. Prior to this processing, address 0 of the memory $M_0$ is accessed to read out the memory confirmation code MC and the code is checked in the detector circuit 45.

These two processings will be described in more detail below. First, the initial signal 55 is fed to the controller 43. In response to this signal 55, the controller 43 generates a reset signal to reset (or initialize) the sound processor 42, the detector circuits 45 and 54, the register 48 and the address generator 51. Further, in the address generator is set an initial address which identifies the memory $M_0$ 27 and designates its first address (address(0)). The address generator 51, further, comprises a decoder (not shown) for generating one of a memory select signal ($C_0$-$C_3$) and a cell select signal, and at this moment, the decoder outputs the memory select signal $C_0$ and a cell select signal for selecting the first address (0) in the memory $M_0$ 27 on the basis of the initial address. Consequently, the MC code of the memory $M_0$ is read out and transferred to the detector circuit 45 via the data bus 34. In this case, since the memory $M_0$ 27 is connected to the address and data buses 35 and 34, an established MC code is stored in the detector 45. If the memory $M_0$ is not connected to the bus, a code different from the MC code is transferred to the detector circuit 45. At a next processing, the detector circuit 45 detects whether the transferred code is correct or not. For instance, the predetermined MC code which is equal to the MC code in the memory and is set in the detector circuit 45 may be compared with the transferred code. As a result, when the memory $M_0$ 27 is connect to the bus, the detector circuit 45 sends an acknowledgement signal 56 to the controller 43. The controller 43 controls the address generator 51 so as to increment the initial address by +1 using a +1 adder 153. Accordingly, at the next timing, the address generator 51 outputs an address (1) to the memory $M_0$ 27.

Now, the address (1) of the memory $M_0$ 27 stores the start address data (leading address data) (k+1) and, therefore, this data (k+1) is sent to the register 49 through the data bus 34. The conroller 43 outputs sequentially a control signal for +1 add operation to the address generator 51. In this operation, the data (m+1) . . . (n+1) in the leading address area of the memory $M_0$ 27 are sequentially read out to the register 49.

Figure 8:
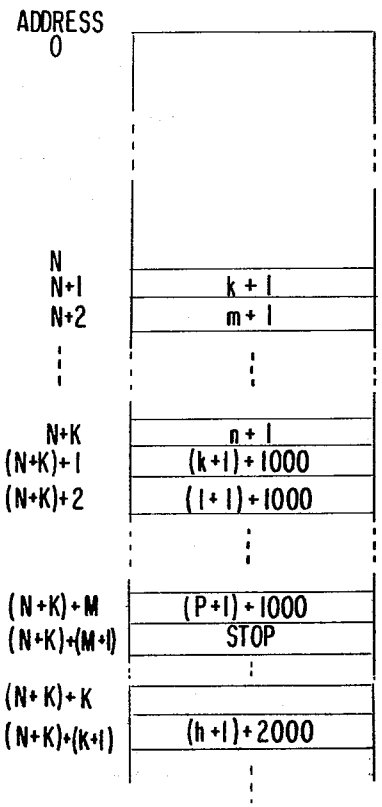
FIG. 8 is a diagram showing a construction of an edit memory within a sound synthesizing unit.

At this moment, the contents of the register 48 are "0". In addition, as shown in FIG. 8, addresses 0 to N of the RAM 22 are reserved for the conventional use of the RAM. Therefore, the data transferred from the memory $M_0$ to the RAM 22 are in themselves set at addresses N+1 to N+k of the RAM 22 via the ALU 50. Here, the number of addresses of address N+1 to address N+k is equal to the number of addresses of address 1 to address k in FIG. 7. Subsequently, another address for addressing the memory $M_1$ 28 is generated in the address generator 51. Further above-described processings are executed. Consequently, the leading address data k+1, l+1, . . . , p+1 read out of the memory $M_1$ are respectively set in the register 49. At this moment, the contents of the register 48 are changed, for example, to "1000" by a control signal 57, and accordingly, when the leading address data are set in the RAM 22 via the ALU 50 the respective data are added with 1000. This provision is made for the purpose of discriminating the memory $M_0$ and the memory $M_1$ from each other in the RAM 22. Thus, the leading addresses read out of the respective memories $M_0$, $M_1$, . . . are set in the RAM 22 as illustrated in FIG. 8. More particularly, the respective leading addresses in the memory $M_0$ are set at RAM addresses N+1 to N+k, and in the same address space the respective leading addresses in the memory $M_1$ are set at RAM addresses (N+k)+1 to (N+k)+k. However, only the area of RAM addresses (N+k)+1 to (N+k)+M are necessary for storing the leading addresses in the memory $M_1$, and therefore, data are not set at the subsequent address locations.

When the data set in the RAM 22 has been finished in the above described manner, the sound synthesizing unit 21 is ready to receive a key data fed from the key input unit 20. This key input is made to correspond to the addresses in the RAM 22. Accordingly, assuming that key "0" (FIG. 3), for example, corresponds to address N+1 in the RAM 22, in response to depression of key "0" an address designating the address location N+1 is generated from the address register 44 and fed to the RAM 22. As a result, an address datum k+1 set at address N+1 is read out of the RAM 22, and this is transferred to the address generator circuit 51. Consequently, a signal $C_0$ for selecting the memory $M_0$ and a signal for selecting address k+1 in that memory are generated from the address generator circuit 51 and fed to the memory $M_0$. The data selected by these signals are sequentially transferred via the data bus DB to the sound processor 42 in the sound synthesizing unit 21. Among the selected data, addresses of parameters $K_1$ to $K_{10}$ are transferred to the ROM 40 instead of the sound processor 42, and regular parameters $K_1$ to $K_{10}$ are derived from the table in the ROM 40 as described previously and transferred to the sound processor 42.

On the other hand, if key "1", for example, is depressed, then address (N+k)+1 in the RAM 22 is designated, and on the basis of this address, the data (k+1)+1000 stored at that address are read out. Since "1000" in the data is a datum for designating the memory $M_1$, a memory selection signal $C_1$ is generated. Consequently a speech information group having address k+1 as its leading address in the memory $M_1$ can be derived.

For these two keys, two leading addresses ("k+1" in the memory $M_0$ and "k+1" in the memory $M_1$) are read out from the RAM 22. These addresses are stored in the address generator 51 and applied to the respective memory. Consequently, the first sound data areas of the memory $M_0$ and $M_1$ are selected, respectively, and the data designated by the leading address "k+1" is read out. The following data in the first sound data area is accessed by increasing the content of the address generator 51 by +1 by means of the +1 adder 153. This adding operation is sequentially executed till the content of the address generator 51 becomes m in the memory $M_0$, and becomes l in the memory $M_1$. Further, another of the leading addresses "m+1" . . . "n+1" or "l+1" . . . "p+1" is designated by another key, such as key 2, key 3, . . . , key 16.

In this operation, when the stop data in FIG. 5 is read out of the memory, it is detected by the stop detector circuit 54 which continuously detects whether the stop data is read out or not. Therefore, when the stop data is read out of the memory, it generates reset signals 58 and 59 to the address generator 51 and the sound processor 42, respectively. As a result, the address generator 51 is reset, and the sound processor 42 stops the speech synthesizing processing.

The synthesized signal in the sound processor 42 is then sent to the parallel-serial converter (P/S) 52. A converted signal 36 is transferred to the digital-analog converter (D/A) 23 shown in FIG. 3 bit by bit.

As described in detail above, in the illustrated embodiment of the present invention, leading addresses of the respective speech information groups in the memories $M_0$ and $M_1$ are prepared in a particular area in each memory, and these leading addresses are stored once in a RAM provided in the sound synthesizing unit at an intialized period. Accordingly, any one key input corresponds to a particular address in the RAM, and even if the memory $M_0$ or $M_1$ is replaced by another memory or an additional memory is added, the relation or correspondence between the key input and the RAM need not be changed. As a result, whatever memories may be used, speech synthesis can be achieved easily by merely mounting a desired memory or memories, so that the speech synthesizer apparatus has an extremely wide utility.

On the other hand, the RAM 22 for storing the leading addresses is provided in the speech synthesizer unit 21. However, this RAM 22 may be provided externally of the synthesizer unit 21, similarly to the memories $M_0$, $M_1$, . . . . In this instance, the external RAM is coupled to the synthesizer unit 21 by the address bus AD and the data bus DB. Further, a program counter may be used as the address generator 51. Furthermore, the +1 adder 153 may be replaced by the ALU 50.

What is claimed is:

1. A speech synthesizer apparatus comprising a first memory device ($M_0$) having a first memory area and a second memory area, said first memory area including a plurality of memory blocks which have different quantities of memory locations and store a plurality of different speech information and said second memory area storing a plurality of name codes designating the respective memory blocks in said first memory area, a second memory device ($M_1$) having a first memory area with a plurality of memory blocks which have different quantities of memory locations and store a plurality of different speech information and a second memory area storing a plurality of name codes designating the respective memory blocks of said first memory area of said second memory device, and a synthesizing unit (21) having a memory means (22) having memory areas for storing the name codes in said first and second memory devices, means (48, 49, 50) for reading said name codes out of said first memory device and out of said second memory device and writing the read name codes into said memory means, means (IN) for receiving an input data, means (44) for converting the received input data into address data designating at least one of the name codes stored in said memory means to read the designated name code out of said memory means, means (51, 53) for producing sequential addresses for accessing speech information of at least one memory block in said first memory device and/or said second memory device designated by said at least one name code read out of said memory means, and means (42) for synthesizing a speech signal by using the accessed speech information.

2. The apparatus claimed in claim 1, in which said synthesizing means has a speech parameter synthesizing circuit and said speech information stored in said first and second memory devices include speech parameters to be synthesized.

3. The apparatus claimed in claim 1, in which said synthesizing means has a waveform synthesizing circuit and said speech information stored in said first and second memory devices includes waveform data to be synthesized.

4. The apparatus claimed in claim 1, further comprising a keyboard means having a plurality of keys and coupled to said synthesizing unit, key codes of said keys being assigned with addresses of said memory means in one-to-one correspondence.

5. A speech synthesizer apparatus comprising at least one memory unit having a first memory area storing a plurality of different speech information blocks and a second memory area storing a plurality of leading addresses designating respectively said plurality of speech information blocks, the respective speech information blocks being set in different address spaces of different lengths, a RAM for storing said leading addresses in said memory unit, a data transfer circuit fetching said leading addresses from said second memory area of said memory unit and writing them into said RAM, a selection means for selecting at least one of said leading addresses stored in said RAM in accordance with a data designating an address of said RAM, a reading means for reading speech information from the speech information block designated by the selected leading address, and a synthesizing means for synthesizing a speech by using the read-out speech information.

* * * * *

UNITED STATES PATENT AND TRADEMARK OFFICE

CERTIFICATE OF CORRECTION

PATENT NO. : 4,429,367

DATED : January 31, 1984

INVENTOR(S) : HIDENORI IKEDA

It is certified that error appears in the above-identified patent and that said Letters Patent is hereby corrected as shown below:

Column 2, line 21, after "in" insert --a--.

Column 3, line 8, after "addresses" insert --)--; after "memory" delete ")".

Column 7, line 31, "inut" should be --input--;

Column 8, lines 28-29, "ΔPI respectively, and ΔAI," should be --ΔPI and ΔAI, respectively,--.

Column 10, line 9, "connect" should be --connected--.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*